US007516929B2

(12) United States Patent
Brustein et al.

(10) Patent No.: US 7,516,929 B2
(45) Date of Patent: Apr. 14, 2009

(54) TABLE EDGE SUPPORTING APPARATUS

(76) Inventors: Alison Brustein, 12845 Hanover St., Los Angeles, CA (US) 90049; Laurie Cohen, 1170 Chantilly Rd., Los Angeles, CA (US) 90077

( * ) Notice: Subject to any disclaimer, the term of this patent is extended or adjusted under 35 U.S.C. 154(b) by 420 days.

(21) Appl. No.: 11/076,271

(22) Filed: Mar. 10, 2005

(65) Prior Publication Data

US 2007/0227991 A1 Oct. 4, 2007

(51) Int. Cl.
*F16B 45/00* (2006.01)

(52) U.S. Cl. ..... 248/304; 248/308; 248/322; 248/323; 248/326; 248/917

(58) Field of Classification Search ..... 248/914, 248/322, 323, 324, 327, 339, 304, 308; 70/456 B
See application file for complete search history.

(56) References Cited

U.S. PATENT DOCUMENTS

| | | | | |
|---|---|---|---|---|
| 1,817,962 | A * | 8/1931 | Breuer | 248/308 |
| 3,379,041 | A * | 4/1968 | Edward | 70/456 R |
| 3,442,103 | A * | 5/1969 | Page | 70/456 R |
| 3,485,070 | A * | 12/1969 | Gleeson | 70/456 R |
| 3,597,950 | A * | 8/1971 | Elsenheimer | 70/456 B |
| 3,608,343 | A * | 9/1971 | Kimel | 70/456 R |
| 3,978,902 | A * | 9/1976 | Adkison | 150/106 |
| 4,033,162 | A * | 7/1977 | Fontana | 70/456 B |
| 4,194,714 | A | 3/1980 | Schultz | |
| 4,210,302 | A * | 7/1980 | Serkez | 248/308 |
| 4,978,093 | A | 12/1990 | Kennedy | |
| 5,094,417 | A | 3/1992 | Creed | |
| 5,458,301 | A | 10/1995 | Cournoyer | |
| 5,594,419 | A | 1/1997 | Lo | |
| 6,345,796 | B1 | 2/2002 | Neuman | |
| 6,481,680 | B2 | 11/2002 | Neuman | |
| 7,219,868 | B2 * | 5/2007 | Marler et al. | 248/304 |
| 7,322,554 | B2 * | 1/2008 | Caroselli et al. | 248/304 |
| 2003/0038220 | A1 * | 2/2003 | Catan | 248/304 |
| 2004/0108432 | A1 * | 6/2004 | Weitzman | 248/339 |
| 2004/0195484 | A1 * | 10/2004 | Sheeran | 248/304 |

* cited by examiner

*Primary Examiner*—Amy J. Sterling
(74) *Attorney, Agent, or Firm*—Fulwider Patton LLP

(57) ABSTRACT

A handbag 12 is supported from a table surface 11. A hook 30 extends from the space between parallel panels 13 and 14 and includes a segment 34 rotatable with pivot block 31 between the panels. In one position (FIG. 1), hook 30 is perpendicular to panels 13 and 14 to support the handbag 12. Hook 30 is rotatable in directions 41 (FIG. 5) to a position between, and parallel to, the panels. Hook 30 is coupled to a pivot 35 to rotate with pivot block 31 in a horizontal plane to a storage position. In this position, hook 43 is fixedly positioned relative to magnet 35. To prevent the hook 30 from being dislodged from surface 11, non-skid members are secured to the bottom surface of panel 14.

6 Claims, 5 Drawing Sheets

TABLE EDGE SUPPORTING APPARATUS

BACKGROUND OF THE INVENTION

1. Field of the Invention

The present invention generally relates to apparatus used to hang or support personal items such as purses or jackets and, more particular, to supporting apparatus employed to support items from the horizontal surface of a table, desk or the like.

2. Prior Art

The prior art discloses numerous devices which are used to hold handbags, purses and the like from the edge of an elevated, horizontal platform such as a table. As a general rule, the devices disclosed by the prior art are intended to be small in size and sufficiently small to be maintained by the user in his or her jacket or handbag.

One of the devices disclosed by the prior art for hanging or otherwise supporting handbags at the edge or periphery of a table, desk or other horizontal support employs an upper member having a first flange adapted to be placed adjacent the support surface and a second flange secured to the first flange extending downwardly. A C-shaped member or hook is secured to the lower terminus of the second flange of the upper member on which the handbag or purse is to be supported. The problems inherent in this device primarily relate to the lack of flexibility for use and storage. Although the C-shaped member is capable of being pivoted relative to the supporting flange, the overall structure cannot be reduced in size for storage. The present invention substantially resolves this inadequacy by providing an apparatus within which a supporting hook is pivotally coupled and which is capable of being stored within its associated housing.

Another support apparatus disclosed by the prior art includes a hook for hanging a purse of other personal item from a table or desk surface. The supporting hook is pivotally coupled to the supporting housing for movement in a plane perpendicular to the table or desk surface. However, the supporting hook cannot be stored within the associated housing. The present invention resolves this inadequacy by providing a coupling between the support hook and housing which permits the supporting hook to be collapsed upon itself and disposed within the confines of the housing for efficient storage thereof.

SUMMARY OF THE INVENTION

The present invention comprises a supporting apparatus to provide means for hanging or otherwise supporting purses, handbags, jackets and the like from the horizontal surface of a table or desk. A housing adapted to be disposed upon the horizontal surface of the table or desk comprises a pair of planar housing panels positioned in parallel spaced relation to one another. An interior wall having a uniform height is disposed between the housing panels and is perpendicular thereto. A pivot block is adapted to be rotatable about an axis perpendicular to the planar panels. A supporting hook is pivotally coupled to the pivot block in a manner which permits the supporting member to be rotated in two planes, one being perpendicular to that the housing panels and one plane being parallel thereto. The pivotability of the supporting member relative to the housing panels permits the supporting hook to be properly oriented relative to the desk or table when in use as well as being disposed and secured between the housing panels for storage.

It is therefore an object of the present invention to provide an improved supporting apparatus for hanging personal items from the horizontal surface of a table or desk.

It is another object of the present invention to provide a supporting apparatus which employs a supporting member which can be collapsed and stored and secured within its associated housing.

It is yet another object of the present invention to provide a collapsible supporting member for personal items which exhibits surfaces for receiving decorative ornamentation.

It is still yet another object of the present invention to provide a supporting apparatus for purses, handbags and the like which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
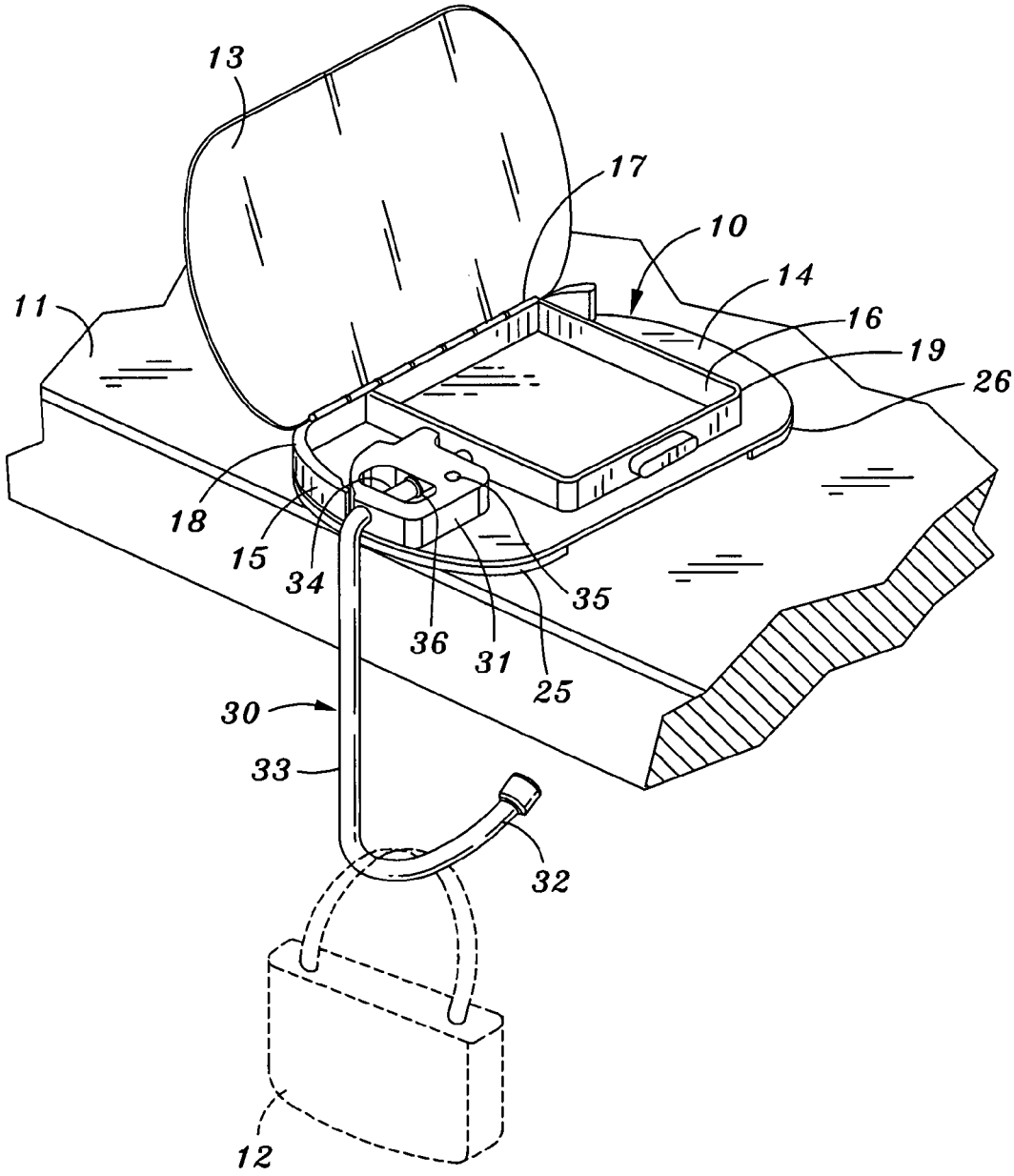
FIG. 1 is a front perspective view of a preferred form of the present invention table edge supporting apparatus illustrating the support of a handbag from a table surface.

An understanding of the present invention supporting apparatus can be best understood by reference to FIGS. 1-6, the present invention supporting apparatus being generally designated by the reference numeral 10. The present invention is intended to support or otherwise hang personal items such as a purse, handbag or jacket from a horizontal desk or table surface 11. In FIG. 1, the present invention supporting apparatus 10 is illustrated supporting a handbag 12.

Figure 2:
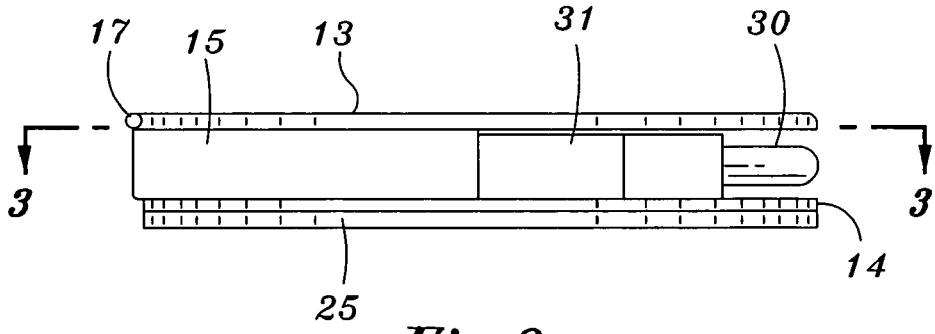
FIG. 2 is a front elevation view of the present invention illustrating the supporting hook in its stored position.

The present invention 10 embodies a housing consisting of a top panel 13 and a bottom panel 14 in parallel spaced relation to each other. The relative position of panels 13 and 14 are maintained by an interior wall comprised of elements 15 and 16 are perpendicular to top and bottom panels 13 and 14. The interior walls 15 and 16 are uniform in height. Although FIG. 1 illustrates an interior wall comprised of a pair of interior wall elements 15 and 16, it is understood interior walls 15 and 16 may be constructed in a unitary manner. It is also understood that top panel 13, bottom panel 14 and wall elements 15 and 16 can be part of an integral structure as opposed to discrete parts. FIGS. 1 and 2 illustrate the use of hinge 17 to pivotally couple top panel 13 to interior wall 15. It is understood that the present invention contemplates the use of an unhinged top panel 13 that is secured to the upper surfaces 18 and 19 of interior walls 15 and 16, respectively.

Figure 4:
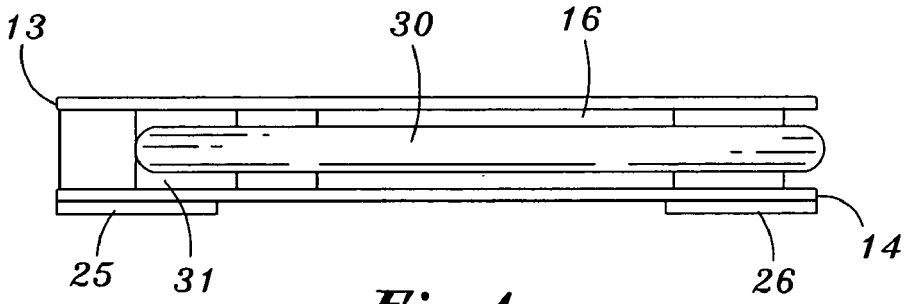
FIG. 4 is a side elevation view of the present invention illustrating the support hook in a stored position.

It is a primary objective of the present invention to provide means to support a handbag 12 or the like from the horizontal surface 11. To prevent the present invention supporting apparatus 10 from being inadvertently dislodged from horizontal surface 11, first and second non-skid members 25 and 26 are secured to the bottom surface of bottom panel 14. Non-skid members 25 and 26 may be constructed from conventional materials having a sticky surface such as rubber or the like. Although the present invention has been described utilizing two non-skid members 25 and 26, it is understood a single non-skid member may be utilized. As shown in FIGS. 1, 2 and 4, when affixed to the bottom surface of bottom panel 14, non-skid members 25 and 26 are disposed adjacent supporting surface 11.

Figure 3A:
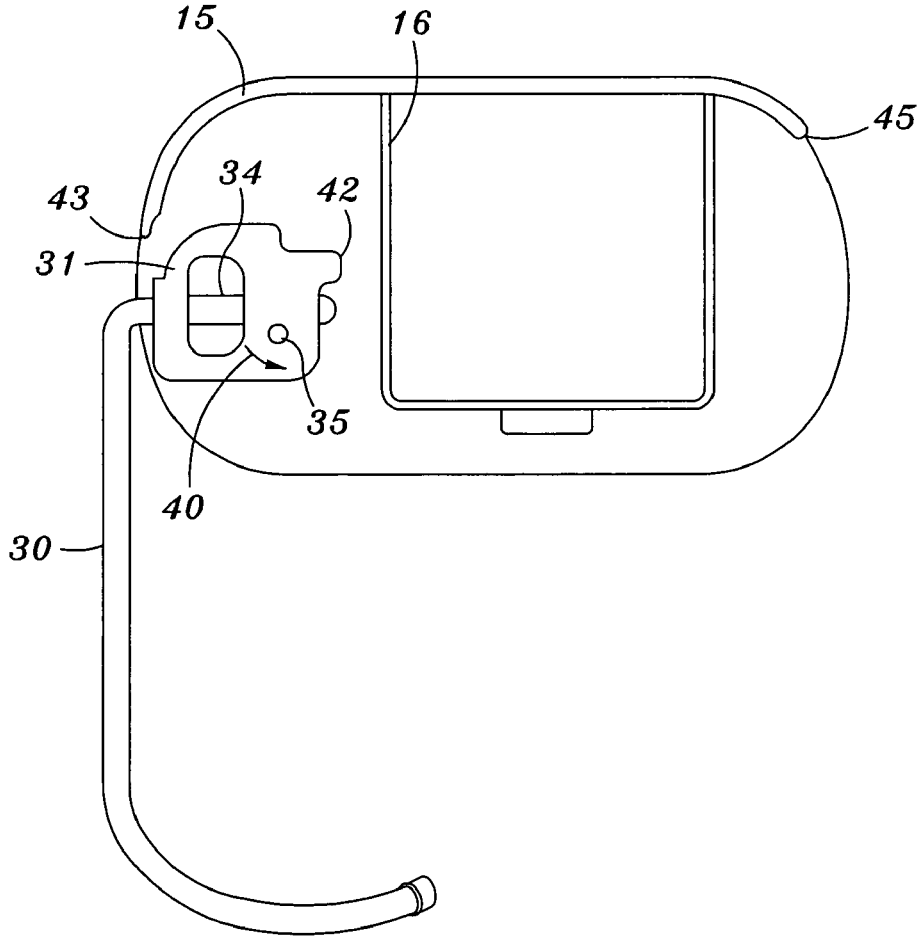
FIG. 3*a* is a partial top plan view of the present invention supporting apparatus taken through line 3-3 of FIG. 2 illustrating the support hook in position for storage.
Figure 3B:
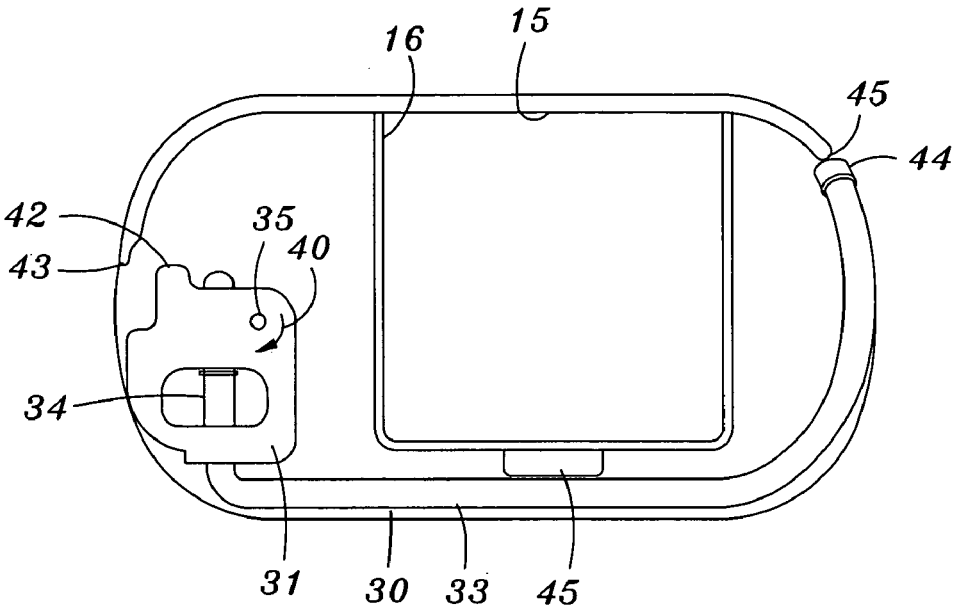
FIG. 3*b* is a partial top plan view of the present invention supporting apparatus taken through line 3-3 of FIG. 2 illustrating the storage hook in a stored position.
Figure 5:
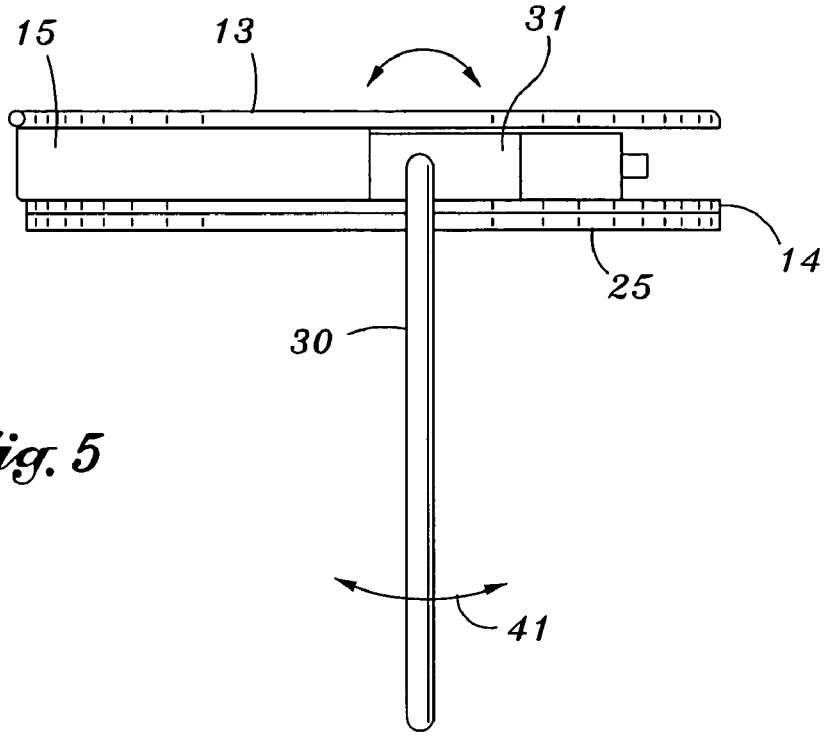
FIG. 5 is a front elevation view of the present invention illustrating the support hook in the extended position.
Figure 6:
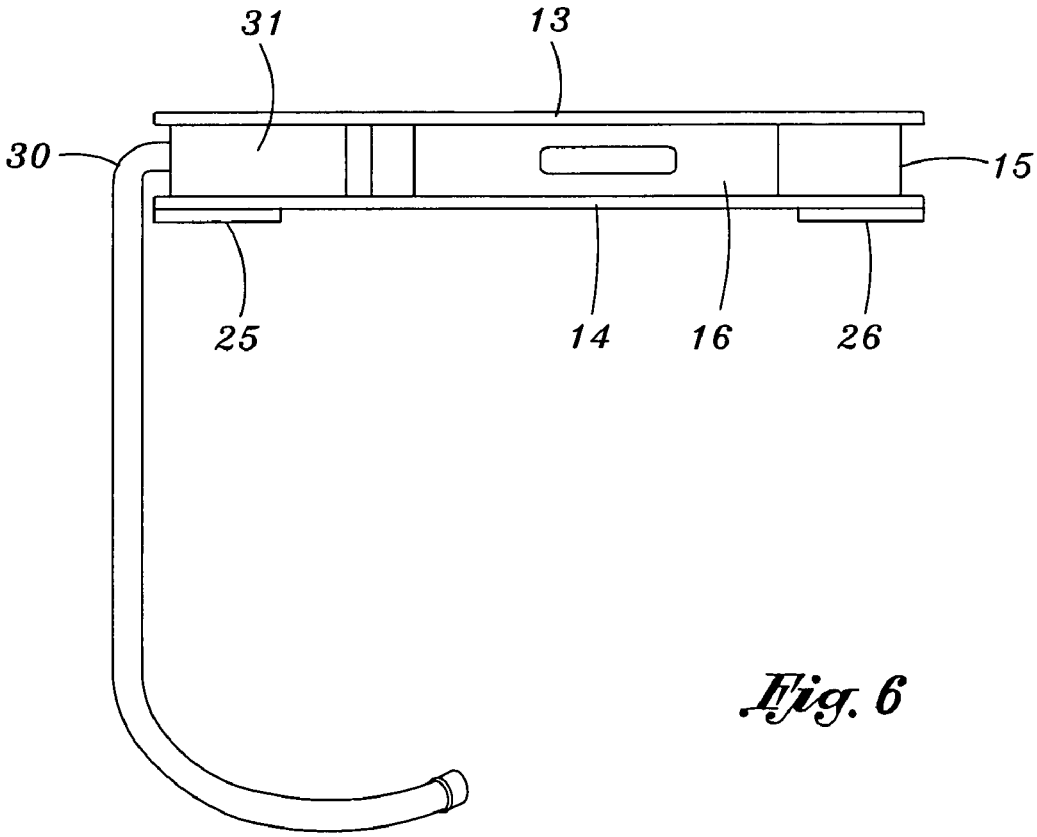
FIG. 6 is a side elevation view of the present invention supporting apparatus illustrating the support hook in an extended position.

A positionable support hook 30 provides the means to support a handbag 11. Support hook 30 comprises a substantially L-shaped flange comprised of contiguous segments 32, 33 and 34. Segment 34 of support hook 30 is pivotally coupled to pivot block 31. Pivot block 31 is rotatably coupled about a supporting pin 35 in the directions designated by reference numeral 40 (FIGS. 3*a* and 3*b*). Supporting pin 35 is secured to bottom panel 14 and is perpendicular thereto. Segment 34 of supporting hook 30 is disposed through aperture 36 (FIG. 1) and is rotatably coupled within aperture 36 in a manner that permits supporting hook 30 to rotate about the axis of segment 34 in the directions indicated by reference numeral 41 (FIG. 5).

In its open, extended position, support hook 30 will be positioned perpendicular to upper and lower planar panels 13 and 14. In the storage position, support hook 30 will be rotated counterclockwise (see FIG. 5) until support hook 30 is positionable between upper and lower planar panels 13 and 14 (FIG. 4).

The storage of supporting hook 30 may be best understood by reference to FIGS. 3*a* and 3*b*. As stated hereinabove, pivot block 31 is rotatable about pivot pin 35 in the manner designated by reference numeral 40. As shown in FIG. 3*a*, support hook 30 has been rotated counterclockwise as shown in FIG. 5 until it lies in a plane intermediate upper and lower planar panels 13 and 14. To store supporting hook 30, as shown in FIG. 3*a*, pivot block 31 is rotated counterclockwise about pivot pin 35 until lobe 42 of pivot block 31 is positioned adjacent detent 43 of interior wall 15. Concurrently, the terminus 44 of segment 32 of support hook 30 will be positioned adjacent the opposing terminus 35 of interior wall 15. To maintain support hook 30 in the stored position, a magnet 45 is secured to a portion of interior wall 16 in a manner that will permit a magnetic attraction between magnet 45 and segment 33 of support hook 30. It is understood by those persons having skill in the art that the operator of the present invention encompasses the storage of support hook 30 independent of magnet 45. When terminus 44 of support hook 30 is positioned adjacent terminus 45 of interior wall 15, support hook 30 will be in a fully stored position.

Figure 7:
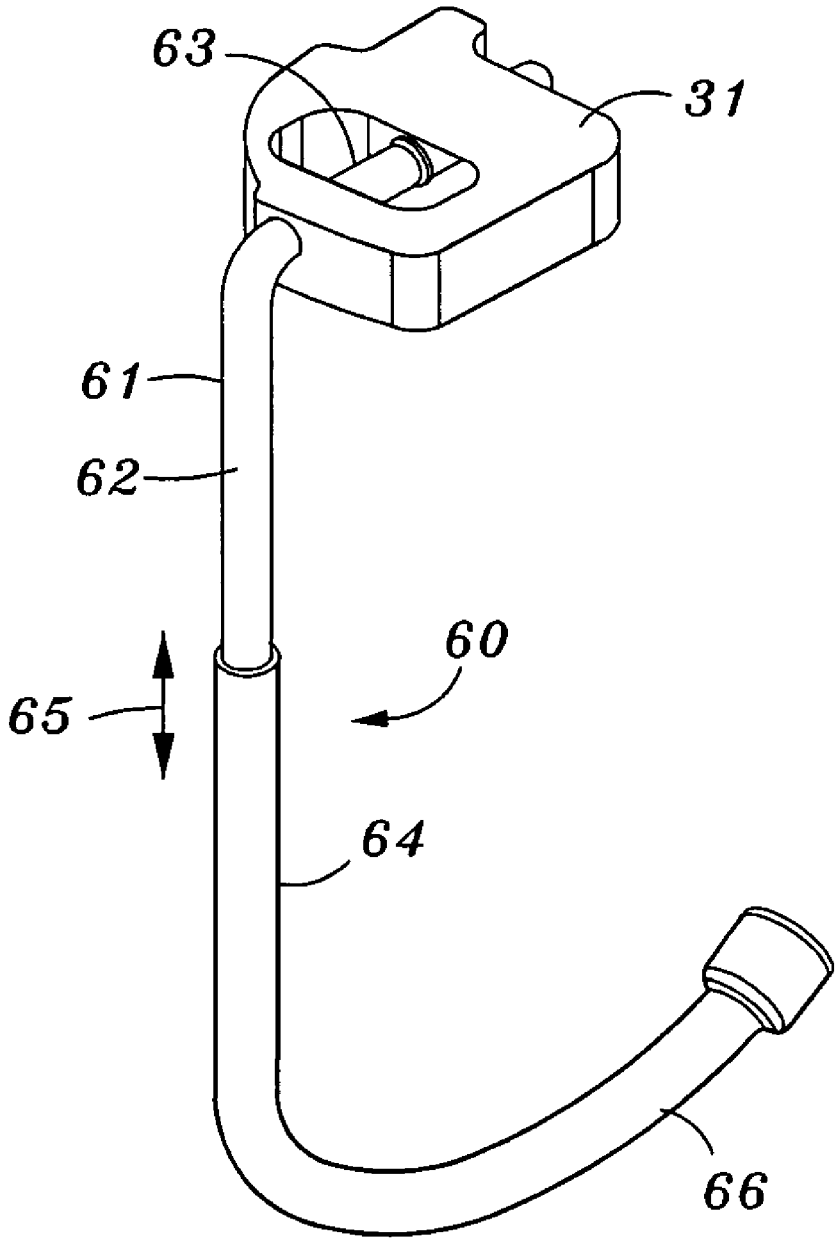
FIG. 7 is a side elevation view of an alternative embodiment of the support hook shown in FIGS. 1-6, inclusive.

An alternative embodiment for the support hook shown in FIGS. 1-6, inclusive, can be best seen by reference to FIG. 7. As stated, it is an objective of the present invention to provide a supporting apparatus for hanging personal items from the horizontal surface of a table or desk. The alternative embodiment of the present invention illustrates a telescoping support hook 60 that is extendable to permit use with tables having vertical obstructions and be collapsible for storage between top panel 13 and bottom panel 14. Storage hook 60 comprises an L-shaped flange 61 constituting of contiguous segments 62 and 63. Segment 63 of support hook 60 is pivotally coupled to pivot block 31 in the manner described with respect to FIG. 1. Segment 62 is slidably engaged within supporting sleeve 64 adapting same to slidably move along the outer surface of segment 62 in the alternative directions identified by reference numeral 65. Support sleeve 64 is extended into a hook 66 which is adapted to support handbags, purses and the like.

We claim:

1. Apparatus for supporting an accessory from a support structure, including:

a support member having an opening defined by a pair of parallel walls, the support member constructed to be disposed on the support structure, a pivot block pivotably disposed in the opening of the support member between the pair of parallel walls, a holder for the accessory formed from segments having a telescoping relationship, the holder having first and second positions and being coupled to the pivot block in the first and second positions, the first position defined by the holder being outside of the opening in the support member and operative in the first position to hold the accessory in a suspended relationship from the support structure, the second position defined by the holder being disposed within the opening in the support member, the holder also being pivotable relative to the pivot block on a first axis and being pivotable with the pivot block on a second axis transverse to the first axis to move the holder between the first and second positions.

2. Apparatus as set forth in claim 1, including a member in the opening in the support member for retaining the holder in the opening in the support member in the second position of the holder.

3. Apparatus for supporting an accessory from a support structure, a support member having an opening and constructed to be disposed on the support structure, a pivot block disposed in the opening in the support structure and constructed to be pivoted in the opening in the structure, an extendible holder formed from extendible segments, the extendible holder also having first and second ends, the first end being disposed in the pivot block for rotation relative to the pivot block on a first axis and pivotable with the pivot block on a second axis transverse to the first axis, the extendible holder being pivotable between a an extended position providing for a position of the support member downwardly from the support structure and a non-extended storage position providing for a disposition of the holder adjacent the support member; and a locking member having magnetic properties disposed on the support member for cooperating with the holder, the holder being magnetizable, for maintaining the holder in the non-extended storage position of the holder.

4. Apparatus as set forth in claim 3 wherein the holder is constructed at the end opposite the pivot block to support the accessory in the first position of the holder.

5. Apparatus as set forth in claim 1 wherein the support member has a bottom having non-skid characteristics.

6. Apparatus as set forth in claim 3 wherein the support member has a bottom having non-skid characteristics.

* * * * *